US006019826A

United States Patent [19]

Pietrobon

[11] Patent Number: 6,019,826

[45] Date of Patent: Feb. 1, 2000

[54] VACUUM CLEANER

[75] Inventor: Silvano Pietrobon, Fonte, Italy

[73] Assignee: W.S. S.P.A., Fonte, Italy

[21] Appl. No.: 08/913,088

[22] PCT Filed: Feb. 29, 1996

[86] PCT No.: PCT/IT96/00038

§ 371 Date: Sep. 9, 1997

§ 102(e) Date: Sep. 9, 1997

[87] PCT Pub. No.: WO96/28082

PCT Pub. Date: Sep. 19, 1996

[30] Foreign Application Priority Data

Mar. 10, 1995 [IT] Italy ..... TV950014 U

[51] Int. Cl.[7] ..... B01D 47/02

[52] U.S. Cl. ..... 96/333; 96/337; 96/342; 96/346; 96/348; 96/351; 96/360; 96/361; 15/353; 55/DIG. 3

[58] Field of Search ..... 15/353; 55/DIG. 3, 55/462, 463, 465, DIG. 19; 96/331, 333, 337, 340, 342, 348, 350, 355, 351, 360, FOR 136, FOR 146, FOR 151, FOR 147, FOR 138, FOR 140, FOR 346

[56] References Cited

U.S. PATENT DOCUMENTS

| | | | |
|---|---|---|---|
| Re. 10,497 | 7/1884 | Lyman | 55/463 |
| 1,363,860 | 12/1920 | Fetters | 55/DIG. 3 |
| 1,664,333 | 3/1928 | Taylor | 96/348 |
| 2,321,653 | 6/1943 | Carlson | 96/350 |
| 2,943,698 | 7/1960 | Bishop | 55/DIG. 3 |
| 5,199,963 | 4/1993 | Scarp . | |
| 5,343,592 | 9/1994 | Parise . | |

FOREIGN PATENT DOCUMENTS

| | | |
|---|---|---|
| 43 38 177 A1 | 5/1995 | Germany . |
| TV91A0117 | 12/1991 | Italy . |
| TV92A0005 | 1/1992 | Italy . |

*Primary Examiner*—Richard L. Chiesa
*Assistant Examiner*—Robert A. Hopkins
*Attorney, Agent, or Firm*—Finnegan, Henderson, Farabow, Garrett & Dunner, L.L.P.

[57] ABSTRACT

A vacuum cleaner having a suction path at least partially submerged in a container of water is subdivided into two parts. An upper part supports a suction motor assembly, and a lower part includes a container of water engaged perimetrically by hooking means to the upper part, and a tubular jacket inside the container partially immersed in the water, so that an annular interspace is formed between respective side facing walls. The interspace forms a siphon to allow suction motor means to draw air and/or liquid from the outside. Also included is a perforated separating diaphragm submerged in the water, and a first removable funnel shaped deflector means placed in an almost suspended position inside the tubular jacket above the water level.

4 Claims, 2 Drawing Sheets

VACUUM CLEANER

TECHNICAL FIELD

This invention has as object a vacuum cleaner of the type with suction path at least partially submerged in a container of water.

This invention can be used as a domestic vacuum cleaner for thorough cleaning of rooms and also as an industrial vacuum cleaner.

BACKGROUND ART

Vacuum cleaners, are already known in prior art. The traditional ones, are essentially made up of a body, supported by feet or pivoting wheels, inside of which an engine group is provided, which sucks the external air with the dirt to be filtered and put back into circulation. Such equipment, sucking the air through a tube, which is gripped by the user, generally allows, according to necessity, the cleaning of dust from carpets, mats, moquette, and similar surfaces, but even more recently the actual floor. The air sucked in this way firstly passes at least one filter, which is generally made up from the same dust-collecting bag, to then, once filtered, be reintroduced, as we have seen, into the surrounding environment. Generally, the filter-bag is made of a particular type of closely-woven material, allowing in this way the circulation of the sucked air, but keeping on the inside only the macrodust and the larger type of dirt.

In the above mentioned solution various drawbacks are noticeable. Firstly amongst these, is the fact that a thorough cleaning of the surface being treated is not possible, but also the fact that an innumerable amount of microdust is reintroduced, which once sucked and removed cannot be held by the traditional filter-bags. Amongst other things, there is the common opinion that the microdust also found between domestic walls is the cause of innumerable allergies verifiable in individuals who frequently complain of annoying symptoms.

A recent solution, consisted in providing in a combined form with a traditional vacuum cleaner, the use of a device also able to wash the surfaces at the same time. More in particular, said equipment always consists of a movable body to which a suction engine group is associated, but on the inside of which a tank is obtained that contains water to distribute on the surfaces to be treated. The air, together with the water previously dispersed by a delivery device applied onto the tube, is subsequently sucked and in this way introduced inside said tank. Here, a kind of right-angled fan placed in correspondence to the sucked air's exit hole, rotating, creates an area of depression that obstructs the reintroduction of the dust agitating at the same time both the water and the air. In this way a precipitation of water and dust is obtained thanks to its catalytic effect, discharging into the surrounding environment only the sucked air partially purified of such residues.

However, also in this case there are noticeable drawbacks. These consist firstly in the fact that the aforesaid equipment cannot operate exclusively as a vacuum cleaner. Secondly, as the surfaces are treated with liquids they remain somewhat damp, even if for a short period of time, which limits the utility and field of the application. Third but not last aspect, the equipment results somewhat complicated and does not allow to further optimize the filtering function of the sucked air.

In the Italian Patent Application N° TV91A000117, an equipment particularly vacuum cleaner and relative filter is described, in which a body is provided for the support of a suction group, and a container, inside of which, in contact with a quantity of water previously introduced and in proximity to the suction mouth, a filter is engaged, said filter being obtained by the processing of vegetal and/or animal fibers. Also state of the art, is the Italian Patent Application for industrial invention N° TV92A000005, consisting in an improvement of said patent, in which, on the inside of the container the following is provided:

- a first filter, being made up of a means of distribution of the air at least partially submerged in an amount of water contained in the underlying basin, said means being directly connected to the suction collector of the air externally extracted;
- a second filter, being engaged on the upper part and in proximity to said means of distribution of the sucked air, said filter being obtained by the processing of vegetal and/or animal fibers;
- water previously introduced in the underlying containing basin, which submerges, at least partially, said distribution means.

One of the aims of the present invention is also to avoid some drawbacks noticeable in the use of the preceding apparatuses. More in particular, it has been observed that the greatest concentration of problems is in the filter feature, which, other than not being easily accessible, clog frequently requiring a constant maintenance for requiring the resetting at the end of each use. Consequently, during the cleaning procedures there is a progressive and substantial reduction of the filtering performance with a loss of the benefits for which a certain type of equipment is chosen, but above all even the more traditional cleaning is made inefficient. Another drawback is given in that it is not suitable for the collection of liquids possibly dispersed, limiting itself predominantly to sucking just the air with the dust in general. In fact, the increase of the liquid level inside the container could interfere with the good working of the motor, which in such a way could be subjected to possible damages and make it extremely dangerous.

More recently, the same applicant, provided an improved vacuum cleaner equipment of the type essentially subdivided into two parts, respectively; a first upper part that comprises the support body of a sucking motor group placed in an opening coated with sound absorbent material and sunk into a first filter placed annularly, and a lower part consisting in:

- a container of water, essentially conical, engaged perimetrically by hooking means, to said body;
- a cylindrical element without ends inside said container held along the edge and partially immersed in the water, obtaining between the facing walls, perpendicular to the bottom, an annular interspace, constituting a siphon, as forced path of air and/or of the liquid sucked from the outside by extraction means;
- at least one dirt separator disc being holed, at the base of the cylindrical element and submerged in the water provided in the container;
- and one or more filters not in contact with the water also of differentiated density, where one is held by the cylindrical element, defining an intermediate air bearing.

In the solution just described, the drawbacks observed can be summarized in the excessive complexity of the structure, which derives from the presence of innumerable filters inside the separation container, that above all would decrease the sucking efficacy. Additionally, notwithstanding the presence of more than one intermediate filter, the drips of water would all the same tend to move up the container until impregnating the filters above, and dangerously the area of the electric suction group. Consequently, a constant maintenance is required, undertaken regularly both in respect of said filters, drying them carefully, as well as with reference to periodical controls of the motor opening.

Another even more recent solution, has provided the replacement of the intermediate discs with filter function for the separation of the air from the mixture of water and sucked dust, with a removable deflector means. Said deflector is placed in an almost suspended position, above the basin containing the water to be shaken (air washing) and having a circular and funnel shape, supported perimetrically by the cylindrical element inside said container of water. The simplification has therefore only affected the lower part of the vacuum cleaner, leaving unaltered the upper part in which the presence of a sponge filter is provided, immediately above said deflector, and below the filter of the rotor. The drawback of this solution is due to the presence of the sponge filter, which above all in the presence of an excessive amount of water, tends to allow the movement of the water particles towards the top without stoping them. The drops, therefore, after having impregnated the sponge filter, still tend to go towards the rotor, impregnating the relative and subsequent filter or -only filter-. The consequences are obvious. Firstly the emission of unpleasant odours, and therefore the necessity of constant maintenance of the first filter, which must be washed well with suitable detergents. Secondly a certain degree of danger, due to the fact that the water moved in this way could also come into contact with some electric parts with inevitable problems.

This and other aims are reached with the present invention as claimed, by means of a vacuum cleaner of the type with suction path at least partially submerged in a container of water, said vacuum cleaner being essentially subdivided into two parts, respectively; an upper part that supports a suction motor means and a lower part consisting of:

said container of water which is engaged perimetrically by hooking means, to said upper part;

a tubular jacket inside said container partially immersed in the water, realizing between the respective side facing walls, an annular interspace, that forms a siphon, to allow the passage of sucked air and/or liquid from the outside by said suction motor means;

at least one perforated separating diaphragm for large dirt, on the base of said tubular jacket, submerged in the water;

a first removable funnel-shaped deflector means, placed in an almost suspended position inside said tubular jacket and above the water level, supported perimetrically by said tubular jacket, characterised in that a second deflector, having the shape of an upside down funnel if compared to the first, is placed above the first, said second deflector being associated to a microfilter engaged in correspondence to a suction inlet of said suction motor means.

In such a way, through the notable creative contribution the effect of which realizes an immediate technical progress, various advantages are achieved. Firstly a more careful separation of the air to be reintroduced into the environment, avoiding the use of sponge filters which, as seen, emit bad odours and require constant maintanance. Secondly, radically stopping the particles of water that tend to move upwards, protecting the micro-filter and the sucking-motor equipment. Third, but not last advantage, a considerable simplicity in manufacture and therefore of assembly, so that intervention for normal maintenance is easy.

Advantageously, to said first and second deflectors, a third deflector, having a conical shape, placed coaxially and overturned if compared to said first deflector, is placed inside the first and extending below the lower edge of the first, said third deflector having a bell shape.

In this way there is a better performance in the suctioned air working, avoiding water suction, because the bubbling water during suction is captured by said third deflector obliging it to refall downwards.

Said third deflector is supported by an axial vertical stanchion engaged to an upper axial clutch to support said second deflector.

In this way a very simple removable construction is made for cleaning and maintenance.

These and other advantages will appear from the subsequent description of preferential solutions with the help of enclosed drawings, execution particular of which are not to be considered limitative but only illustrative.

Figure 1:
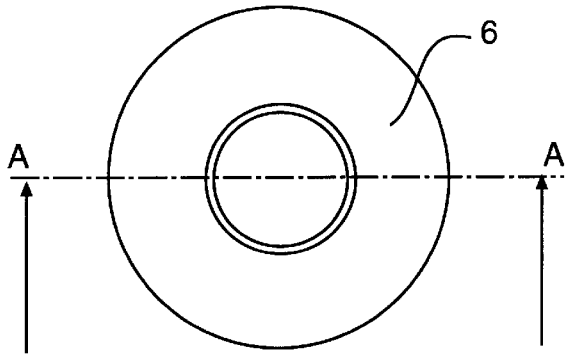
FIG. 1, represents a plane view of a second deflector device introduced inside of a vacuum cleaner equipment.
Figure 2:
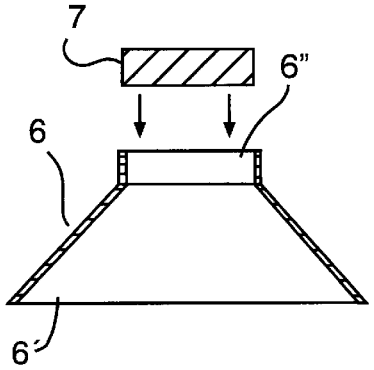
FIG. 2, represents a section view of the deflector of the preceding figure, taken along the cross axis A—A.
Figure 3:
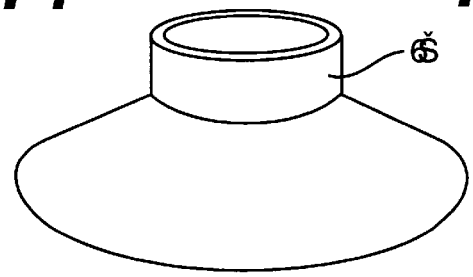
FIG. 3, represents a perspective view of the deflector, which incorporates the microfilter of the rotor.
Figure 4:
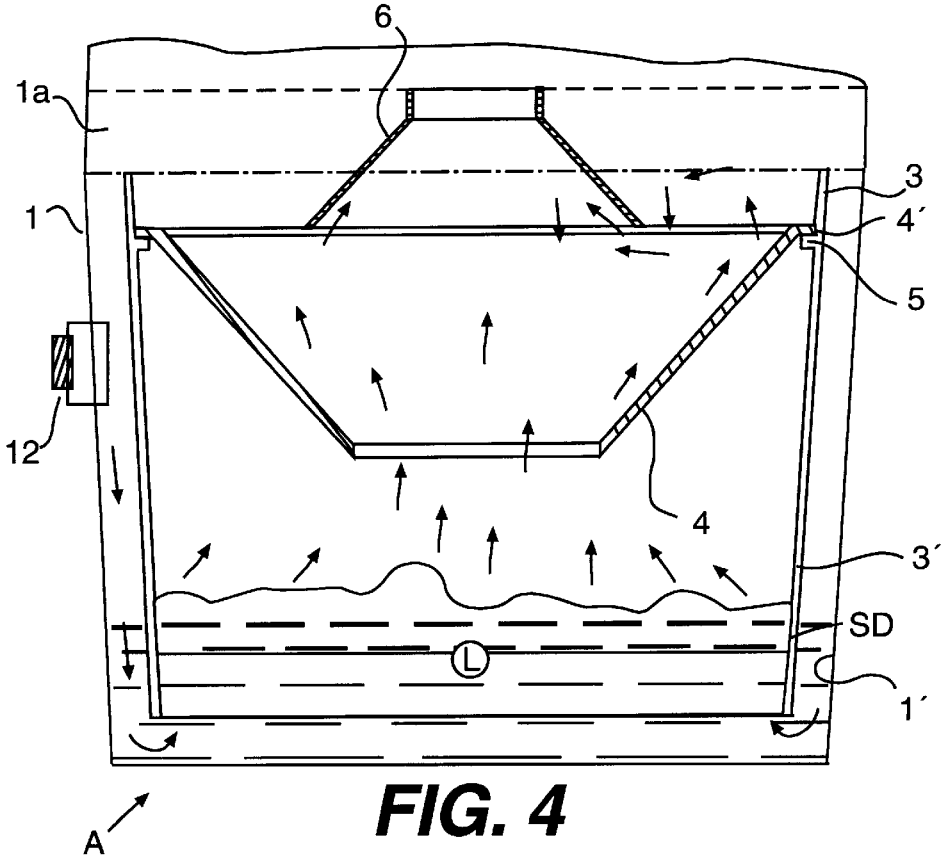
FIG. 4, represents in axial section and partial view, the internal part of a vacuum cleaner, with a second deflector device.
Figure 4A:
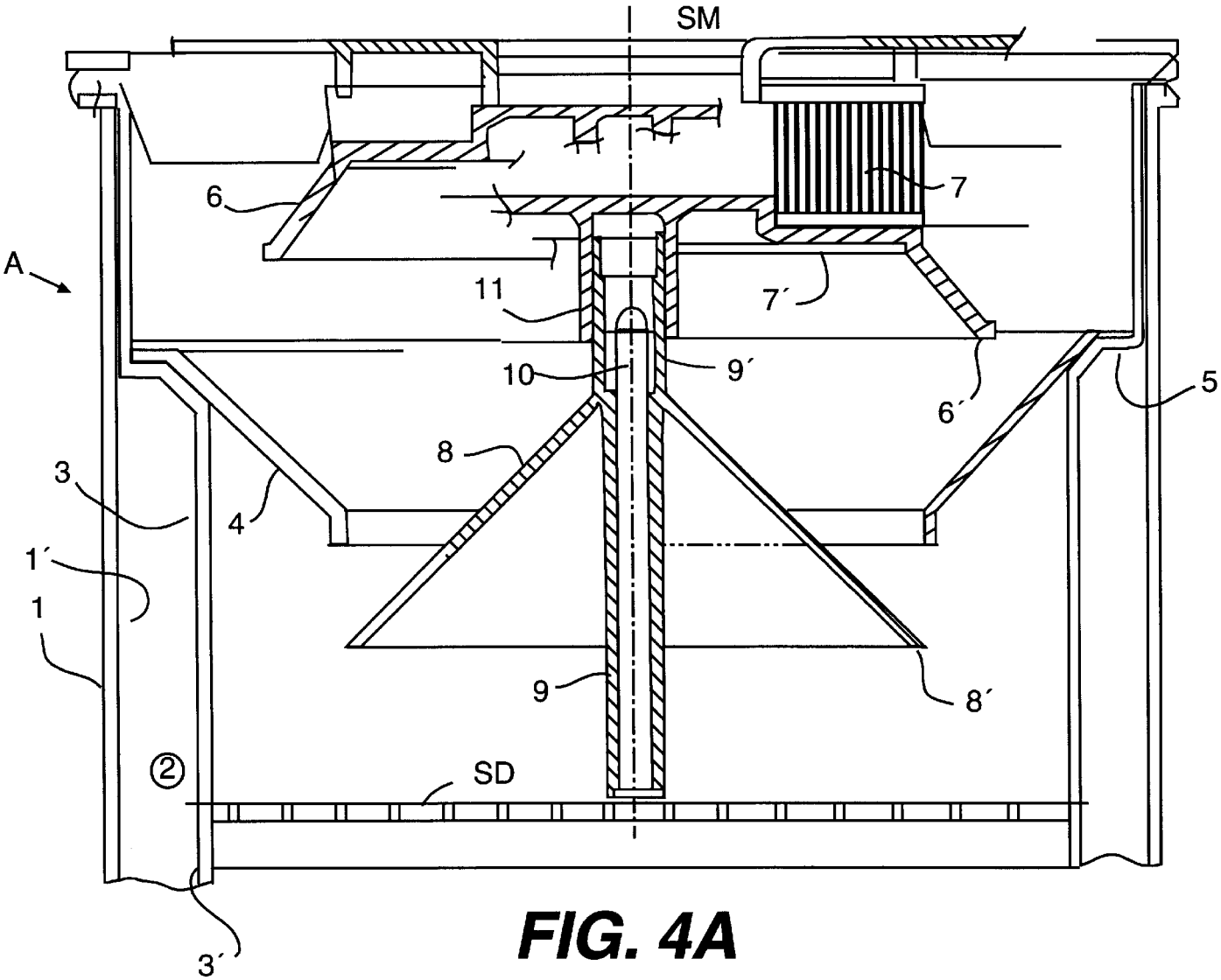

FIG. 4A, represents in axial section and partial view, the internal part of a vacuum cleaner, with a third deflector device As per the figures, it is disclosed that a vacuum cleaner (A), is formed essentially of two parts, respectively a first upper part (1a) that supports the suction motor means (SM), and a second lower part (1), containing water (L), inside of which at least one microfilter (7) is provided for cleaning the air sucked by said suction motor means (SM), using a flexible tube (12). In more detail the suction motor means (SM) of the known type, creates a depression, conveying the air and/or the water mixed with the dust inside the lower part of water container (1). On the inside of said water container (1) there is a removable tubular jacket (3), the walls of which (3') are maintained a certain distance from those opposite (1') of said water container (1). Therefore, an annular interspace (2) is obtained, inside of which, the sucked air/water flows and is subsequently sucked towards the bottom of said water container (1), partially filled with water (L), the lower edge of said tubular jacket (3) being immersed in said water (L), realizing a siphon. As a result of the depression obtained inside the chamber of said first upper part (1*a*), the air/water sucked from the exterior, surpasses the siphon and proceeds upwards, the suspended water being separated from the air by said deflectors, and then re-introduced into circulation. During the path, the air passing in the water siphon contributes to the shaking of the water (bubbling), submitting the air to washing and cleaning, the dirt is separated, precipitating bit by bit, in a continuous up and down action, depositing on the bottom.

With the aim of preventing the upward movement of the water in the vacuum cleaner (A), both because of the suction as well as the shaking, a first suspended deflector device (4) is provided, this being supported by a pronounced border (4'—5) made on the internal perimeter of said removable tubular jacket (3).

More in detail, said first deflector (4), either metallic or plastic, has a funnel shape, which allows better performance in separating the water from the air in connection with the internal walls (3') of the tubular jacket (3), while the reduction of the hole at the end of the funnel of the first deflector (4), allows a uniform distribution of the air flow directed towards the top. Additionally, perimetrically to said first deflector (4), a seal may be associated, allowing the latter to adhere perfectly to the support wall of said removable tubular jacket (3).

As per this invention, a second deflector (6), is placed above said first deflector (4), and has an analogous funnel/bell shape. More in detail, said second deflector (6) is overturned if compared to the first one in order to offer in a downwards direction, the part having a larger lower diameter (6'), while, the upper part narrowing, connects the microfilter (7) in a ring fashion on the suction mouth of the motor suction means (SM). The microfilter (7), also known as the -absolute- type filter, may be received along the support base of the motor group coplanarly joined, being held by the same fins that compress it along the side, or engaged by screw means. In this case the fixing of said second deflector (6) may be made subsequently by means which allow to engage the neck (6") of said second deflector (6) perimetrically to said microfilter (7), said neck being as high as the microfilter (7). In a second hypothesis, the microfilter (7) may be provided already integrated in the neck (6") of said second deflector (6) to allow a quicker and easier removal when maintenance is required. Finally, in a better solution, said second deflector (6), has the diameter of the lower border (6') greater than the opening (smaller diameter) made on the lower border of said first suspended deflector (4), while the upper diameter of the upper opening (neck 6") is lower in respect to said lower border of said first suspended deflector (4).

In the better solution there is a third deflector (8), having a 12 bell shape (upside down funnel shape), placed coaxially and overturned if compared to said first deflector (4), being supported by a coaxial vertical stanchion (9) engaged to a coaxial male vertical clutch.

More in detail, this second solution regards a third conical deflector essentially bell shaped (8), the base diameter (8') mostly corresponds to the diameter of the lower opening of said first deflector (4). The height of said third deflector (8), partially enters said first deflector (4), protracting itself along the same and leaving an abundant perimetrical interspace for outflow towards the top of the sucked air. Said stanchion (9) being tubular, is integral with the third bell deflector (8), this stanchion (9) extends downwards beyond the respective lower border of the third bell deflector (8), obtaining in this way the spacing of the third deflector, from the bottom. Above the third bell deflector (8) an axial male clutch (10) is provided, able to be introduced coaxially to the inside of an analogous axial downwards female bush extension (11) of said second bell deflector (6). In this way a simultaneous support of both second and third deflectors is allowed. In FIG. 4A a perforated diaphragm (SD) to separate the deposited larger dirt in the water (L), is disclosed.

I claim:

1. A vacuum cleaner having a suction path at least partially submerged in a water container, comprising:

an upper part supporting a suction motor means; and a lower part including the water container engaged perimetrically by fastening means to the upper part, the lower part further comprising:

a tubular jacket disposed within the water container and partially immersed in water, cooperating with the water container to define an annular interspace adapted to allow passage of air and/or water drawn by the suction motor means;

at least one perforated separating diaphragm disposed in the water, adjacent a base of the tubular jacket, adapted to capture large parties of direct;

a first removable funnel shaped deflector having a lower opening disposed inside the tubular jacket, supported perimetrically in suspension above the water by the tubular jacket;

a second funnel shaped deflector having an upper opening, inverted relative to the first funnel shaped deflector, disposed above the first funnel shaped deflector, and engaging a suction inlet of the suction motor means;

a third bell shaped deflector having a lower opening and disposed below and partially axially within the first deflector, wherein the diameter of the lower opening of said third bell shaped deflector substantially corresponds to the lower opening of said first deflector, said third bell deflector including a tubular stanchion integral therewith and extending vertically downwards beyond a lower boundary of the third bell deflector to abut the perforated separating diaphragm; and a micro filter attached to the second funnel shaped deflector and connected to the suction inlet of the suction motor means.

2. A vacuum cleaner according to claim 1, wherein the diameter of a lower opening of said second funnel shaped deflector is greater than the diameter of a lower opening of said first suspended funnel shaped deflector and the diameter of the upper opening of said second deflector is smaller than the diameter of the lower opening of said first suspended funnel shaped deflector.

3. A vacuum cleaner according to claim 1, wherein a top portion of said third deflector partially enters said first funnel shaped deflector, forming an annular interspace for outflow of the drawn air towards the suction motor means.

4. A vacuum cleaner according to claim 1, wherein said stanchion extends above the third bell deflector and further comprises an axial male fitting for fastening to a corresponding female fitting extending from said second bell deflector.

* * * * *